US007735911B2

(12) United States Patent
Chen

(10) Patent No.: US 7,735,911 B2
(45) Date of Patent: Jun. 15, 2010

(54) COLLAPSIBLE HIGH CHAIR FOR CHILDREN

(75) Inventor: Shun-Min Chen, Taipei Hsien (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 452 days.

(21) Appl. No.: 11/285,615

(22) Filed: Nov. 22, 2005

(65) Prior Publication Data

US 2007/0024095 A1 Feb. 1, 2007

Related U.S. Application Data

(63) Continuation-in-part of application No. 10/623,981, filed on Jul. 21, 2003, now Pat. No. 7,029,064.

(51) Int. Cl.
*A47D 1/02* (2006.01)

(52) U.S. Cl. ..... 297/16.1; 297/336

(58) Field of Classification Search ..... 297/6, 297/16.1, 335, 336, 46, 48, 51, 52
See application file for complete search history.

(56) References Cited

U.S. PATENT DOCUMENTS

| | | | | | |
|---|---|---|---|---|---|
| 1,327,475 | A | * | 1/1920 | Howell | 297/271.4 |
| 2,771,124 | A | * | 11/1956 | Borsani | 297/313 |
| 2,973,804 | A | | 3/1961 | Gill | |
| 3,198,575 | A | * | 8/1965 | Hawkins | 297/328 |
| 3,427,069 | A | | 2/1969 | McDonald | |
| 3,649,074 | A | | 3/1972 | McDonald et al. | |
| 3,856,352 | A | * | 12/1974 | Jacobi, Sr. | 297/423.15 |
| 4,739,959 | A | * | 4/1988 | Meiller | 297/328 |
| 4,768,825 | A | | 9/1988 | Quinlan, Jr. | |
| 4,778,217 | A | * | 10/1988 | Lane | 297/334 |
| 4,968,092 | A | | 11/1990 | Giambrone | |
| 5,332,283 | A | * | 7/1994 | Gray | 297/129 |
| 5,468,051 | A | | 11/1995 | Huang | |
| 5,489,138 | A | | 2/1996 | Mariol et al. | |
| 5,669,664 | A | | 9/1997 | Perego | |
| 6,033,020 | A | * | 3/2000 | Ito | 297/302.4 |
| 6,161,898 | A | | 12/2000 | Brevi | |
| 6,203,102 | B1 | | 3/2001 | Helmderfer et al. | |
| 6,347,833 | B1 | | 2/2002 | Chen | |
| 2001/0019219 | A1 | * | 9/2001 | Helmsderfer | 297/130 |

FOREIGN PATENT DOCUMENTS

| | | |
|---|---|---|
| DE | 20218013 | 5/2003 |

* cited by examiner

*Primary Examiner*—Peter R. Brown
(74) *Attorney, Agent, or Firm*—Gauthier & Connors LLP

(57) ABSTRACT

A collapsible high chair for children comprises a frame, a seat portion, a backrest and an adjusting mechanism, all of which are sequentially connected with. The adjusting mechanism further comprises a pivotal member and a first engaging unit for connecting the seat portion with the frame at a first portion and a second portion of the pivotal member. Two actuating pieces of the first engaging unit respectively cooperate with two rods and make the rods be removed from the pivotal member at the first portion so as to allow the seat portion being pivotally rotated about the second portion. Also, the backrest can be rotated relative to the seat portion, so that the volume of the collapsed high chair is very small. Besides, the seat portion includes at least a movable piece with a bump for be engaged into the slits with different height at the arm of the seat portion to adjust the tray in height.

21 Claims, 14 Drawing Sheets

COLLAPSIBLE HIGH CHAIR FOR CHILDREN

CROSS REFERENCE TO RELATED APPLICATION

This application is a continuation-in-part of patent application Ser. No. 10/623,981 filed on Jul. 21, 2003 now U.S. Pat. No. 7,029,064.

FIELD OF THE INVENTION

The present invention relates generally to a collapsible high chair for children, and more particularly to a collapsible high chair whose seat portion can be pivotally rotated relative to a frame.

BACKGROUND OF THE INVENTION

As shown in FIG. 1, a conventional high chair 9' (or a stroller) mainly comprises a seat portion 1', a backrest 2', an arm 12', a frame 4', a plurality of wheels 8' and a tray 3', all of which are pivotally connected together. However, when the conventional high chair 9' is collapsed, only the frame 4' can be collapsed into two parallel bars or moreover the backrest 2' is adjusted to parallel with the frame 4', but the angle between the seat portion 1' and the frame 4' can by no means be adjusted. Therefore, the front-rear seat portion 1', almost perpendicular to the frame 4', has a large longitudinal size and thus not only lots of packing material is consumed but also too much transportation space is occupied. It consequently wastes the packing material, increases the transportation cost and is inconvenient for users to carry the high chair 9' outdoors.

On the other hand, the conventional high chair 9' only has a button (not shown) for collapsing the high chair 9'. Hence, if the button is mistakenly pressed or broken down, the infant in the high chair 9' may drop down or be jammed.

SUMMARY OF THE INVENTION

Accordingly, the present invention relates to a collapsible high chair for children that can substantially obviate one or more of the problems due to the limitations and disadvantages of the related arts.

One object of the present invention is the provision of a collapsible high chair with small volume after being collapsed.

Another object of the present invention is the provision of a collapsible high chair which is convenient to be carried.

A further object of the present invention is the provision of a collapsible high chair with lower packing and transportation cost.

Yet another object of the present invention is the provision of a collapsible high chair with collapsing button, and even if the collapsing button is mistakenly pressed or broken down, the infant in the high chair by no means has the risk of dropping down.

Additional features and advantages of the invention will be set forth in the description which follows, and in part will be apparent from the description, or may be learned by practice of the invention. The objectives and advantages of the invention will be realized and attained by the structure particularly pointed out in the written description and claims hereof as well as the appended drawings.

To achieve these and other advantages and according to the purpose of the present invention, as embodied and broadly described, a collapsible high chair for children comprises: a seat portion; a backrest pivotally connected to the seat portion; a frame; and an adjusting mechanism which connects the seat portion with the frame; said adjusting mechanism further comprising: a pivotal member which is located on the frame and connected with the seat portion at a first portion and a second portion; and a first engaging unit which is installed on the seat portion; said first engaging unit further comprising: a first rod secured with the seat portion; a second rod movably received in the first rod; wherein the second rod fixes the seat portion at a predetermined angle relative to the frame when engaged with the pivotal member at the first portion, and allows the seat portion to be pivotally rotated relative to the frame about the second portion when the second rod is disengaged from the pivotal member.

Moreover, the first engaging unit further comprises a first elastic element and another second rod which are movably received in the first rod, and the first elastic element is situated between the two second rods.

Additionally, the first engaging unit further comprises an actuating piece which is secured with the second rod.

Furthermore, the first engaging unit further comprises a third connecting element which secures the actuating piece with the second rod and is movably received in a flute of the first rod.

It is preferred that the actuating piece has an ear for being conveniently actuated.

It is preferred that the actuating piece has a sleeve portion which is circumferentially and movably mounted with the first rod.

It is preferred that the adjusting mechanism further has a pin which is received within both the seat portion and the pivotal member at the second portion to serve as a pivot for the seat portion to be pivotally rotated.

It is preferred that both the seat portion and the pivotal member respectively have a collar engaged with each other at the second portion to serve as a pivot for the seat portion to be pivotally rotated.

It is preferred that the adjusting mechanism further has a pin which is located at centers of the collars and received within both the seat portion and the pivotal member at the second portion to serve as a pivot for the seat portion to be pivotally rotated.

It is preferred that the seat portion has a boundary and the pivotal member has a bulge, adjacent the second portion, which is movably received in the boundary to limit a rotation range of the seat portion.

It is preferred that the seat portion includes a seat plank and an arm extending away from the seat portion, and the first portion as well as the second portion of the pivotal member are respectively connected with the arm.

It is preferred that the high chair further has a tray which is movably connected to the arm.

It is preferred that the height of the pivotal member on the frame can be adjusted.

It is preferred that the frame has a plurality of apertures situated at different heights, and the pivotal member is provided with a tenon which is optionally positioned in one of the apertures to adjust the height of the pivotal.

Another aspect of the invention relates to a collapsible high chair for children. The collapsible high chair comprises: a frame; a seat portion pivotally connected with the frame and being able to be pivotally rotated between a stretched state and a collapsed state; and a first engaging unit situated on the seat portion and being able to be slid between an engaging position where the first engaging unit is engaged with the frame and a disengaging position where the first engaging unit is released from the frame; wherein the seat portion is kept in the stretched state when the first engaging unit is in the engaging position, and the seat portion is in the collapsed state when the first engaging unit is in the disengaging position.

It is preferred that the first engaging unit includes a first rod secured with the seat portion and a second rod movably received in the first rod.

It is preferred that the high chair further comprises a pivotal member which has a first portion and a second portion, wherein the pivotal member is located on the frame and pivotally connected with the seat portion at the second portion, and the first engaging unit is retractably connected with the pivot member at the first portion.

It is to be understood that both the forgoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principle of the invention. In the drawings.

DETAILED DESCRIPTION OF THE INVENTION

Figure 1:
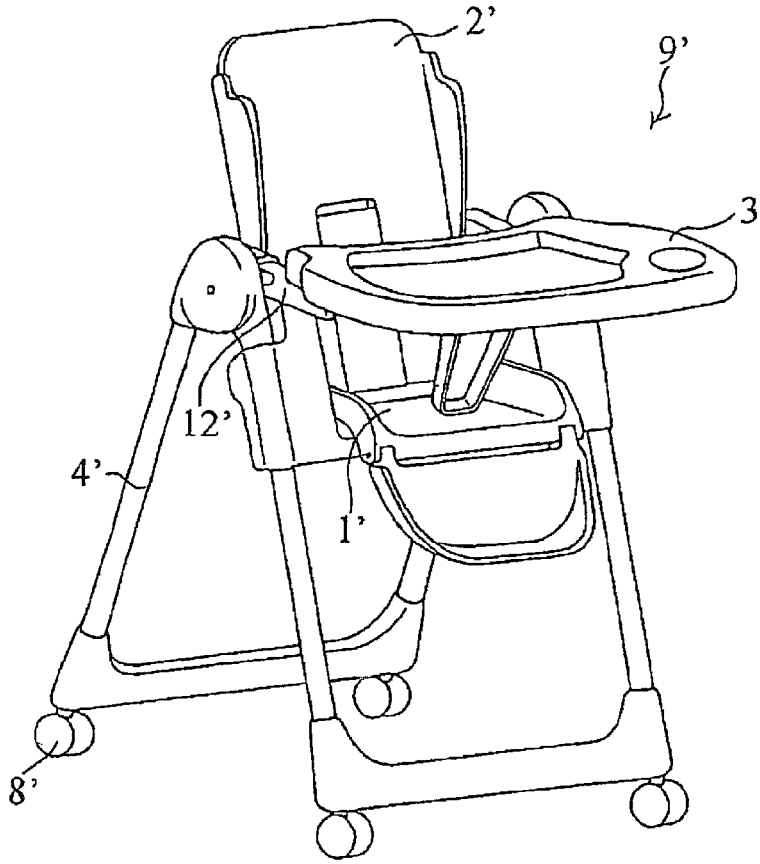
FIG. 1 Prior Art
FIG. 1 is an assembled perspective view illustrating a conventional high chair.
Figure 2:
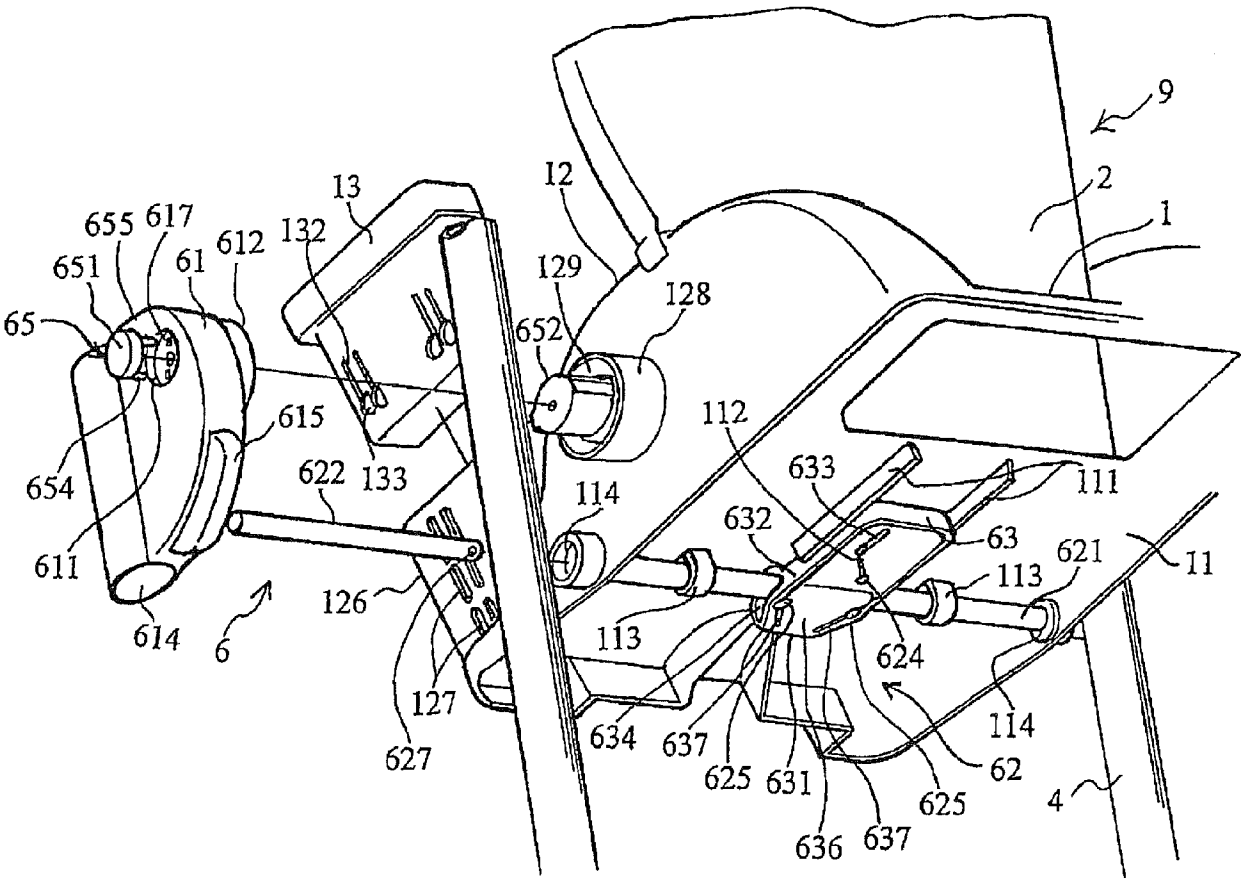
FIG. 2 is a partially exploded perspective view illustrating the elements of an adjusting mechanism of a collapsible high chair according to the first preferred embodiment of the present invention.
Figure 3:
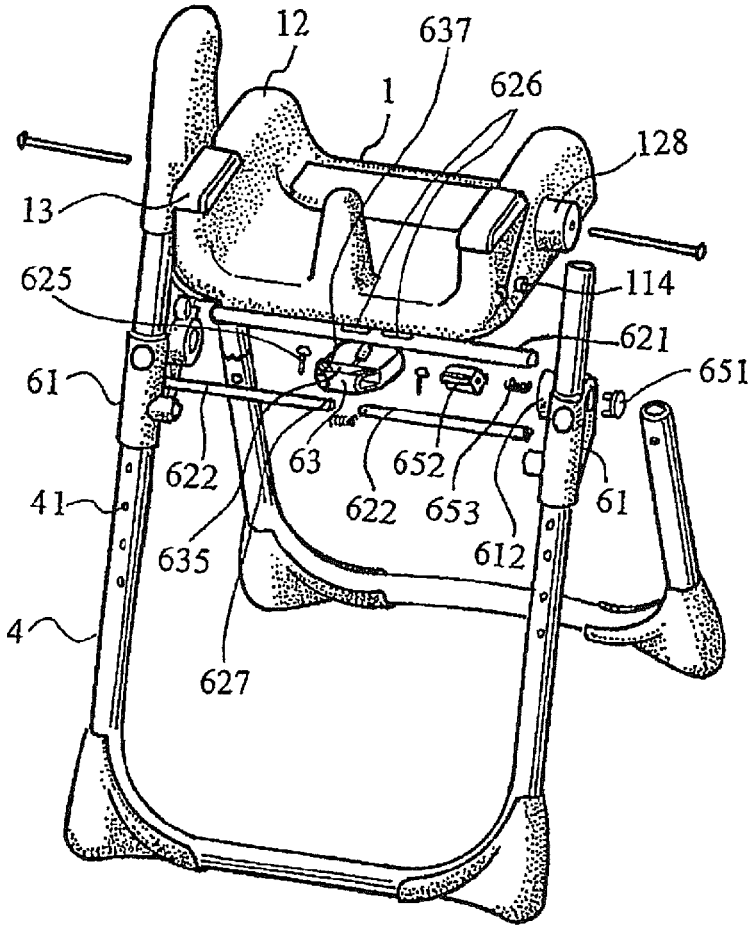
FIG. 3 is another partially exploded perspective view similar to FIG. 2.
Figure 4:
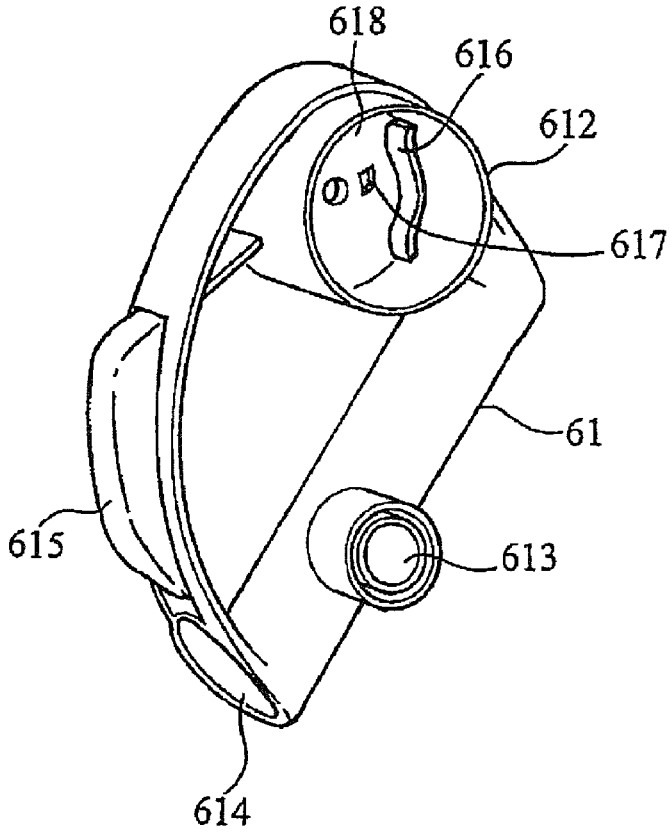
FIG. 4 is a perspective view of a pivotal member of the collapsible high chair according to the first preferred embodiment of the present invention.
Figure 5:
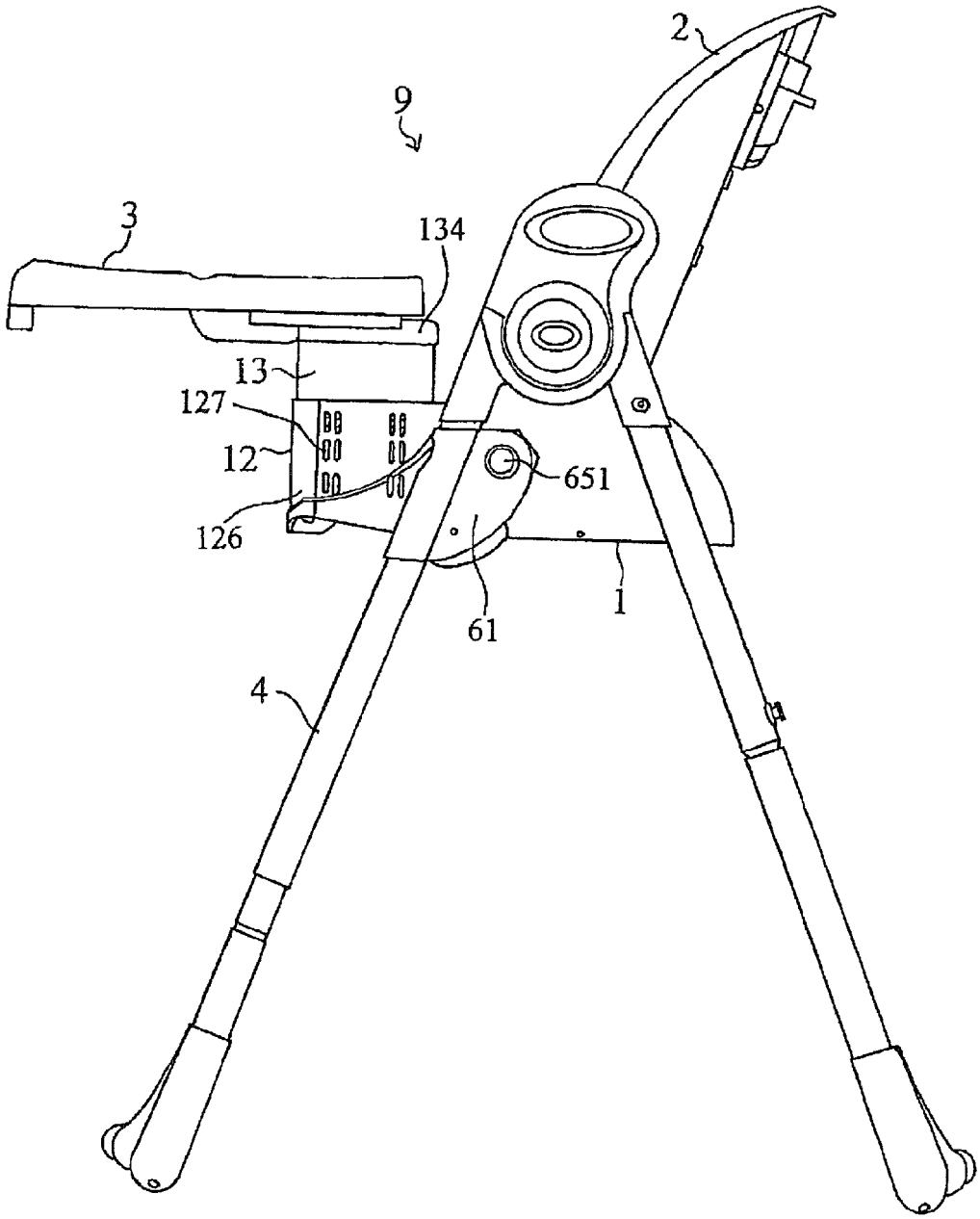
FIG. 5 is an assembled side view of the collapsible high chair according to the first preferred embodiment of the present invention.

The 'rod' in the present invention includes solid rod and hollow tube. The collapsed state generally means half-collapsed state shown in FIG. 8, completely collapsed state shown in FIG. 9, or both, if not specifically indicated.

The First Preferred Embodiment

As shown in FIGS. 2, 3, 4 and 5, a collapsible high chair 9 for children according to the first preferred embodiment of the present invention comprises a seat portion 1, an upwardly extending backrest 2 pivotally connected to rear part of the seat portion 1 at two sides, a tray 3 for being placed articles thereon connected onto front part of the seat portion 1 at two sides, a downwardly extending frame 4 pivotally connected to middle part of the seat portion 1 at two sides, and an adjusting mechanism 6 installed at the bottom surface of the seat portion 1 and laterally extending to engage with the frame 4 at two sides, wherein the prior art can be adopted as the pivotally connecting structure and the adjusting structure of inclination between the seat portion 1 and the backrest 2, so that there is no further description thereof hereinafter.

The seat portion 1 comprises a tabular seat plank 11, two arms 12 upwardly extending respectively from two sides of the seat plank 11, and two T-shaped movable pieces 13 partially accommodated respectively in the arms 12.

The seat plank 11 has two longitudinal costas 111 in parallel extending from the bottom surface thereof at central part, an annular stake 112 extending downward between two costas 111, two lateral rings 113 respectively provided outside of two costas 111 and at the front part of the seat plank 11, two holes 114 formed at two lateral sides and aligned with two rings 113.

Each arm 12 respectively has a second (female) collar 128 outwardly and perpendicularly extending from the outer wall thereof at the center part and a beehive-shaped ledge 129 in the female collar 128. A shell 126 with an upward opening is formed at the front half section of each arm 12. Four column of slits 127, three in each column, are juxtaposed on outer wall of each shell 126 and four slits 127 laterally aligned with each other are constructed a group. Two laterally parallel flexible fingers 132, each with two round bumps 133 at lower end thereof, are integrally molded at lower section of each movable piece 13.

The top end 134 of each movable piece 13 is engaged with the bottom end of the tray 3 and the lower section of each movable piece 13 is accepted in the shell 126 of each arm 12. By means of the four bumps 133 being engaged into one group of slits 127 formed on the shell 126, the tray 3 is secured at a predetermined height above the arm 12. When the bumps 133 are pressed from outside to inside by one hand, the bumps 133 are retracted into the shell 126 due to elastic deformation of the flexible fingers 132. At the same time, the movable pieces 13 are pulled up or pushed down by another hand and then by means of elastic deformation of the flexible fingers 132, the bumps 133 are engaged into another groups of slits 127 to secure the tray 3 at a predetermined height above the arms 12 in order to achieve the object of adjusting the tray in height for being adapted to all infants or children with different statures. When the bumps 133 are engaged into the lowest group of the slits 127, the high chair 9 is adapted to be folded at this state so as to reduce the volume after being collapsed.

Besides, the tray 3 can be further separated from the movable pieces 13 to make the volume of the collapsed high chair 9 smaller.

The adjusting mechanism 6 comprises two semicircle-like pivotal members 61, a first engaging unit 62, and a second engaging unit 65.

One of pivotal members 61 includes a circular recess 611 equipped at upper part of the outer side wall thereof, a first (male) collar 612 laterally extending from inner side wall thereof and aligned with the recess 611, a notch 613 provided at lower part of inner side wall thereof, a longitudinal thimble 614 configured at the diameter of the semicircle, a key 615 installed at the circumference of the semicircle. In addition, at least a round rib 616 extends from the bottom 618 of the male collar 612 near the edge as well as two rectangular openings 617 are formed on the bottom, aligned with the same diameter, and reached to the recess 611. However, another pivotal member 61 only has the male collar 612, notch 613, thimble 614 and key 615 but does not have the recess 611, rib 616 and openings 617.

The second engaging unit 65 comprises a circular button 651, a beehive-shaped cam 652, and a second elastic element 653. The button 651, at two sides, respectively has a tab 654 with a barb 655 (shown in FIG. 6) at distal end thereof.

Press the key 615 of the pivotal member 61 to retract the tenon (not shown) extending into the thimble 614 and then make a rod of the frame 4 be received in the thimble 614 of the pivotal member 61. Slide the pivotal member 61 to a predetermined height and then stop pressing the key 615 to make the tenon be engaged into one of apertures 41 of the frame 4. Another pivotal member 61 without the rib 616 is installed with the frame 4 at the other side in the same way.

Sequentially, mount the second elastic element 653 of the second engaging unit 65 and the cam 652 into the ledge 129 at one side of the seat portion 1. On the other hand, make the two tabs 654 of the button 651 penetrate the pivotal member 61 through the opening 617. Then, in the manner of abutting the outer surface of the cam 652 against the side surface of the ledge 129, insert the male collar 612 of the pivotal member 61 into the female collar 128 of the seat portion 1. Due to the exertion of restoration force of the second elastic element 653, the cam 652 will be always kept at the most projective position so that the outer side surface near the front end of the cam 652 is also always abutted against the side of the rib 616, together with the rear end of the cam 652 being restricted by the ledge 129, which provides the function of preventing the seat portion 1 from rotating relatively to the pivotal member 61. Besides, the barbs 655 of the button 651 grapple the male collar 612 at the bottom 618 thereof and hence it is difficult for the button 651 to be escaped from the pivotal member 61.

The first engaging unit 62 includes a hexagonal sliding piece 63 integrally formed, a first rod 621, two second rods 622 accommodated in the first rod 621 together with a first elastic element 623, a first connecting element 624, and at least a second connecting element 625.

The sliding piece 63 includes a trapezoid section 631 at front part and a rectangular section 632 at rear part. The rectangular section 632 has a longitudinal slot 633 at central part thereof. The hollow trapezoid section 631 has two passages 634 respectively at two inclined planes and four elongated holes 637 with two respectively at the upper wall 635 and lower wall 636 and each near one inclined plane. The front ends of two elongated holes 637 at the same wall 635 or 636 are closer than the rear ends thereof.

The first rod 621 has four flutes 626 in all with two laterally juxtaposed at one side and another two at another side respectively aligned on the same diameter. Each second rod 622 has two eyelets 627 aligned on the same diameter of one end thereof.

Put the sliding piece 63 of the adjusting mechanism 6 between two costas 111 and make the annular stake 112 of the seat portion 1 insert into the slot 633 of the sliding piece 63. Then screw a first connecting element 624 such as a screw into the annular stake 112 to movably restrict the sliding piece 63 at the bottom of the seat plank 11. Next, pass the first rod 621 through the holes 114, the rings 113 of the seat plank 11, and the passages 634 at two sides of the trapezoid 631 of the sliding piece 63 in sequence in order to secure the first rod to the bottom of the seat plank 11. Sequentially, after installing the first elastic element 623 into the first rod 621, two second rods 622 are inserted into the first rod 621 respectively from two holes 114 in the manner that the ends with the eyelets 627 are faced each other. Furthermore, pass two second connecting elements 625 such as rivets respectively through two elongated holes 637 at the upper wall 635 of the trapezoid section 631 of the sliding piece 63, two flutes 626 juxtaposed laterally at one side of the first rod 621, the eyelets 627 of two second rods 622, another two flutes 626 at another side of the first rod 621, and two elongated holes 637 at the lower wall 635 of the trapezoid section 631 of the sliding piece 63 as well as simultaneously make the ends without eyelets 627 of two second rod 622 respectively protrude out of the seat plank 11 at two sides thereof so as to be engaged into the notches 613 of two pivotal members 61 as a result of fixing the seat portion 1 with the frame 4.

Figure 6:
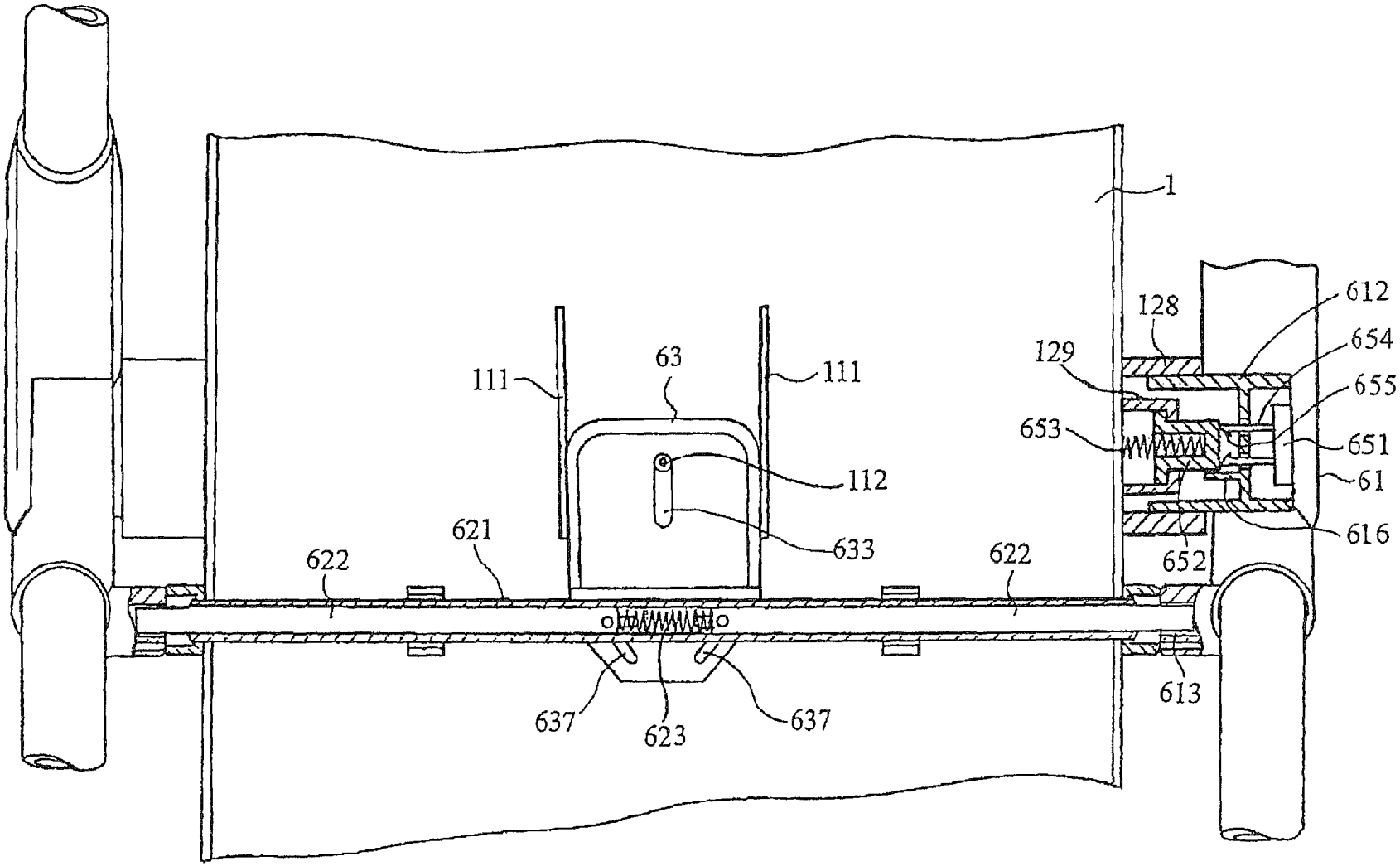
FIG. 6 is a partially sectional bottom view of the collapsible high chair according to the first preferred embodiment of the present invention illustrating both engaging states of a first engaging unit and a second engaging unit.

Incorporating FIG. 6 into reference, the above description is related to the stretched state (or erect state) of the high chair 9 for children according to the present invention wherein two second rods 622 are engaged into the notches 613 of the pivotal members 61 and the cam 652 of the second engaging unit 65 is abutted against the rib 616 of the pivotal member 61. By the way of fixing the seat portion 1 at two points on each side, the seat portion 1 can be firmly secured to the frame 4 without the risk of turning over.

Figure 7:
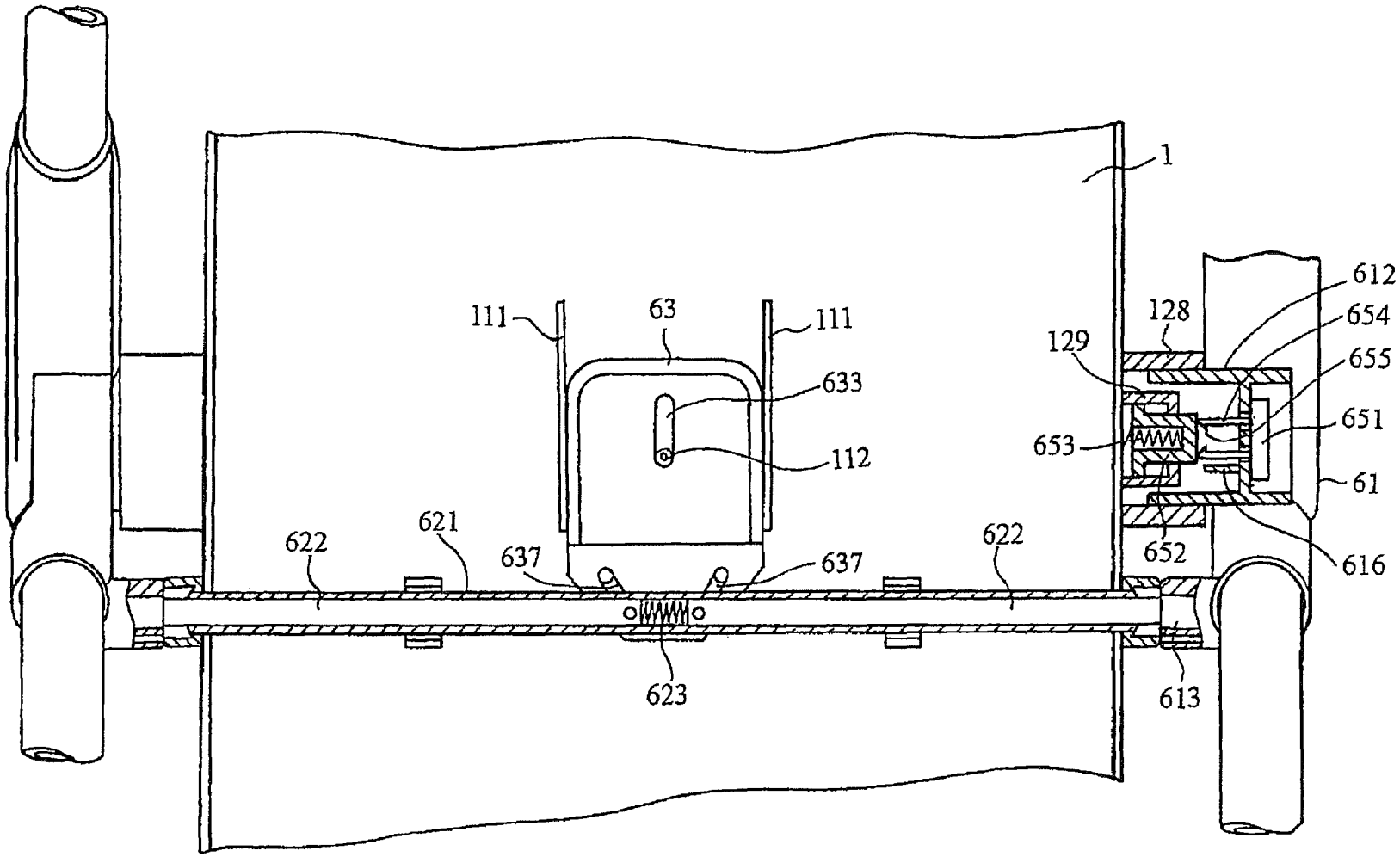
FIG. 7 is similar to FIG. 6 but illustrating both unengaged states of a first engaging unit and a second engaging unit.

Incorporating FIG. 7 into reference, when folding the high chair for children is desired, pull with one hand backwardly the sliding piece 63 which backwardly slides under the guide of the annular stake 112 and costas 111 at the bottom of the seat plank 11. Because the second connecting elements 625 are restricted from front-rear longitudinal movement by the first rod 621, two second connecting elements 625 move respectively from the rear ends to the front ends of four elongated holes 637 when the sliding piece 63 moves backwardly. Further because two lateral elongated holes 637 are not parallel with each other, that is, the distance between two rear ends of two lateral elongated holes 637 is larger than that of two front ends thereof, when two second connecting elements 625 respectively move from the rear ends to the front ends of two elongated holes 637, the lateral distance between two second connecting elements 625 is shortened at the same time and thus two second rods 622 are cooperated and moved near each other. The movement of two second rods 622 results in compressing the first elastic element 623 on one hand, and on the other hand retracting two second rods 622, which protrude out of two sides of the seat plank 11, to escape from the notches 613 and get rid of the restriction of the pivotal members 61. However, the cam 652, which cannot be rotated, is still abutted by the rib 616 of the pivotal member 61 so that the seat portion 1 cannot be pivotally rotated relatively to the frame 4 yet.

At the meanwhile that the sliding piece 63 of the first engaging unit 62 is backward pulled by one hand, if the button 651 of the second engaged unit 65 is pushed by another hand simultaneously, the cam 652 is pushed into interior of the arm 12 by the front ends of the tabs 654 of the button 651 to the extend that the cam 652 is beyond the end surface of the rib 616 and escape the cam 652 from the restriction of the rib 616 to permit the seat portion 1 being rotated relative to the frame 4 and the female collar 128 and male collar 612 engaged with each other function as a pivot.

The sliding piece 63 is designed to release the engagement of seat portion 1 and pivotal member 61 to make the seat portion 1 can be pivotally rotated when it is desired for the high chair 9 to be collapsed. However, if the high chair 9 for children is only provided with a first safety lock, comprising sliding piece 63 and second rods 622, to limit the seat portion 1 from rotating, the rotatable seat portion 1 will make the infant therein drop down or moreover be hurt when sliding piece 63 is mistakenly pulled resulting in the second rods 622 being escaped out of the notches 613 of the pivotal member 61. Accordingly, the second engaging unit 65 with the cam 652 unable to rotate can serve as a secondary safety lock. On the contrary, when the high chair 9 is in the state of being stretched and the sliding piece 63 of the first safety lock is engaged at its normal position, even the button 651 of the secondary safety lock is mistakenly pressed, the seat portion 1 still does not have the risk of rotating relative to the frame 4 since there are two connecting points therebetween in that the second rods 622 of the first safety lock and the female collar 128 of the seat portion 1 (near the secondary safety lock) are respectively engaged in the notches 613 and male collar 612 of pivotal member 61. Therefore, the high chair 9 according to the present invention is very safe in the state of being stretched and used and can avoid the infant therein from dropping down or being hurt when one of the engaging units 62, 65 breaks down or is mistakenly operated.

Figure 8:
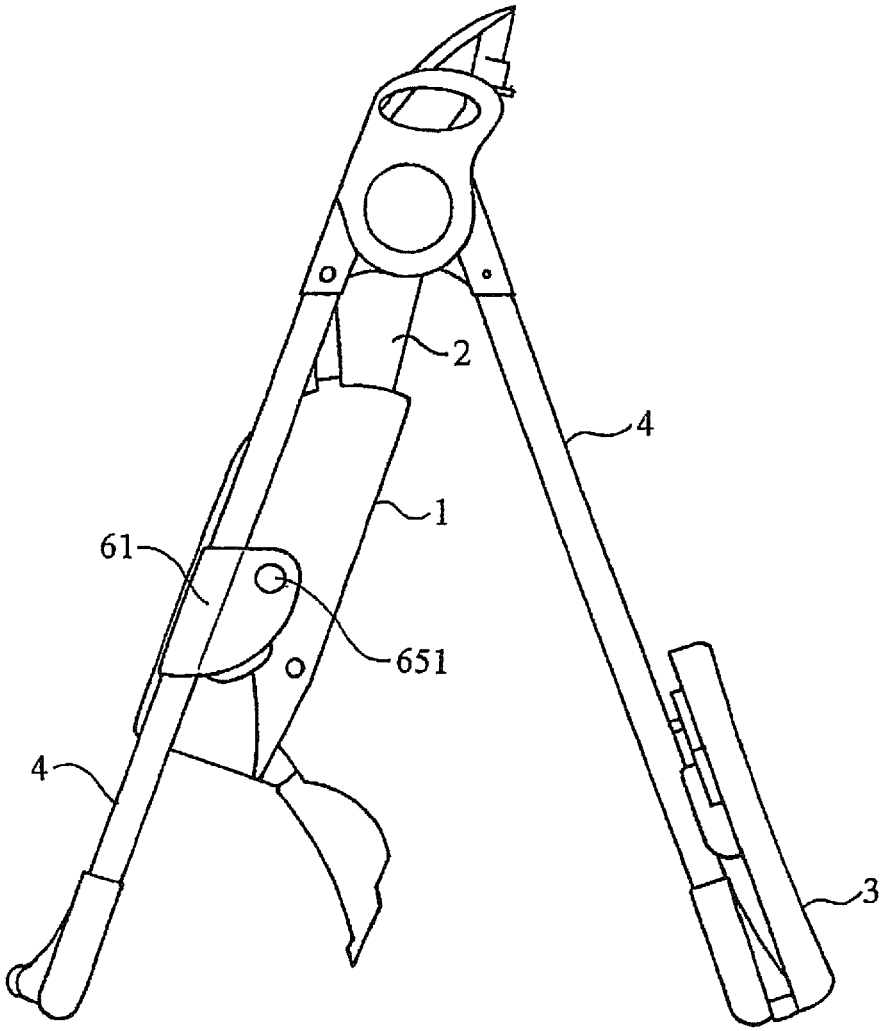
FIG. 8 is a side view of the collapsible high chair according to the first preferred embodiment of the present invention illustrating the high chair is in a half-collapsed state.
Figure 9:
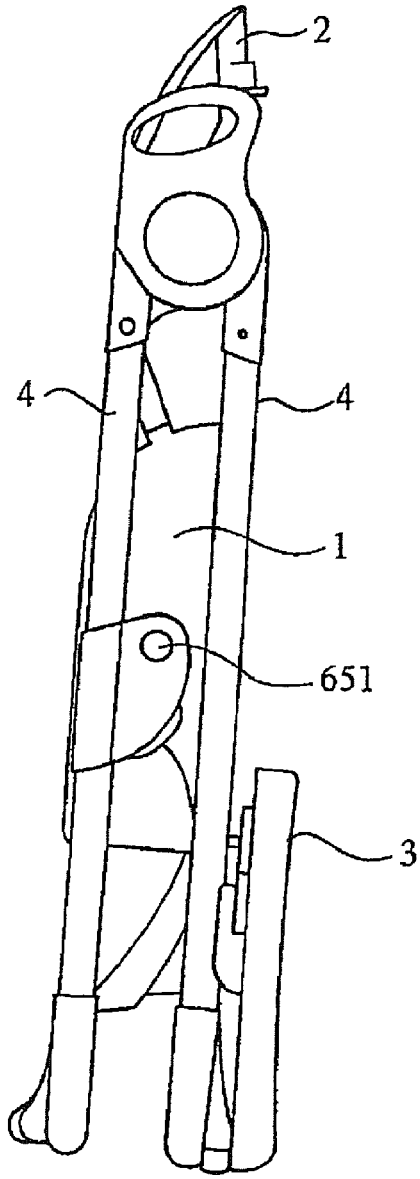
FIG. 9 is similar to FIG. 8 but in a completely collapsed state.

As shown in FIGS. 8 and 9, when it is desired to fold the high chair 9, at first, the movable piece 13 is adjusted to the lowest position or the tray 3 is further separated from the movable piece 13. Next, the backrest 2 is pivotally rotated backward to have about 180 degrees relative to the seat portion 1, which can be achieved by a conventional mechanism. Then, the sliding piece 63 is pulled backward with one hand to the extent that the second rods 622 are respectively escaped from the notches 613 of the pivotal members 61. Simultaneously, the button 652 is pressed with another hand to the extent that the cam 652 is escaped from the rib 616. At this time, the seat portion 1 can be forward rotated about 90 degrees to make both the seat portion 1 and the backrest 2, having about 180 degrees therebetween, parallel with the frame 4 so as to reduce front-rear size in width of the high chair 9 after being collapsed. Sequentially, the keys 615 of the pivotal members 61 are pressed and the pivotal members 61 are slid down along the frame 4 to low down both the seat portion 1 and backrest 2 in order to reduce up-down size in height of the high chair 9 after being collapsed. Consequently, the volume of the high chair 9 after being collapsed is very small, which is not only convenient for users to carry with outdoors but also largely reduces packing material needed to be consumed for the manufacturers. Besides, transportation cost is down because space occupied on the transportation means is decreased.

When it is desired to stretch and use the high chair 9 from the collapsed state of the present invention, the reverse sequential steps can be adopted and operated. At the meantime, while the seat portion 1 is pivotally rotated to almost parallel with ground, the cam 652 is pushed out by restoration force of the second elastic element 653 and is engaged into the bottom 618 of the male collar 612 of the pivotal member 61 as well as is abutted by the side surface of the rib 616. After the sliding piece 63 is released from the hand, the second rods 622 are outward pushed into the notches 613 of the pivotal member 61 to secure and position the seat portion 1 at the state of be stretched by the restoration force of the first elastic element 623 in the first rod 621.

The best mode of the first preferred embodiment according the present invention is described above. However, in alternative embodiment, the high chair 9 of the present invention may be provided with only the first engaging unit 62 or only the second engaging unit 65. If the high chair 9 is provided only with the first engaging unit 62 and without the second engaging unit 65, then the seat portion 1 can be secured to the pivotal member 61 by the first engaging unit 62 and collar 128, 612. On the other hand, if the high chair 9 is provided only with the second engaging unit 65 and without the first engaging unit 62, then the seat portion 1 can be secured to the pivotal member 61 by the second engaging unit 65.

The Second Preferred Embodiment

Besides the seat plank 11 and arm 12 of the seat portion 1 are slightly modified in the second preferred embodiment, the main differences between the second and first preferred embodiments exit in the adjusting mechanism 6. Hence, only the modified structures are described hereinafter and the descriptions about the same structures between two embodiments will be omitted.

Figure 10:
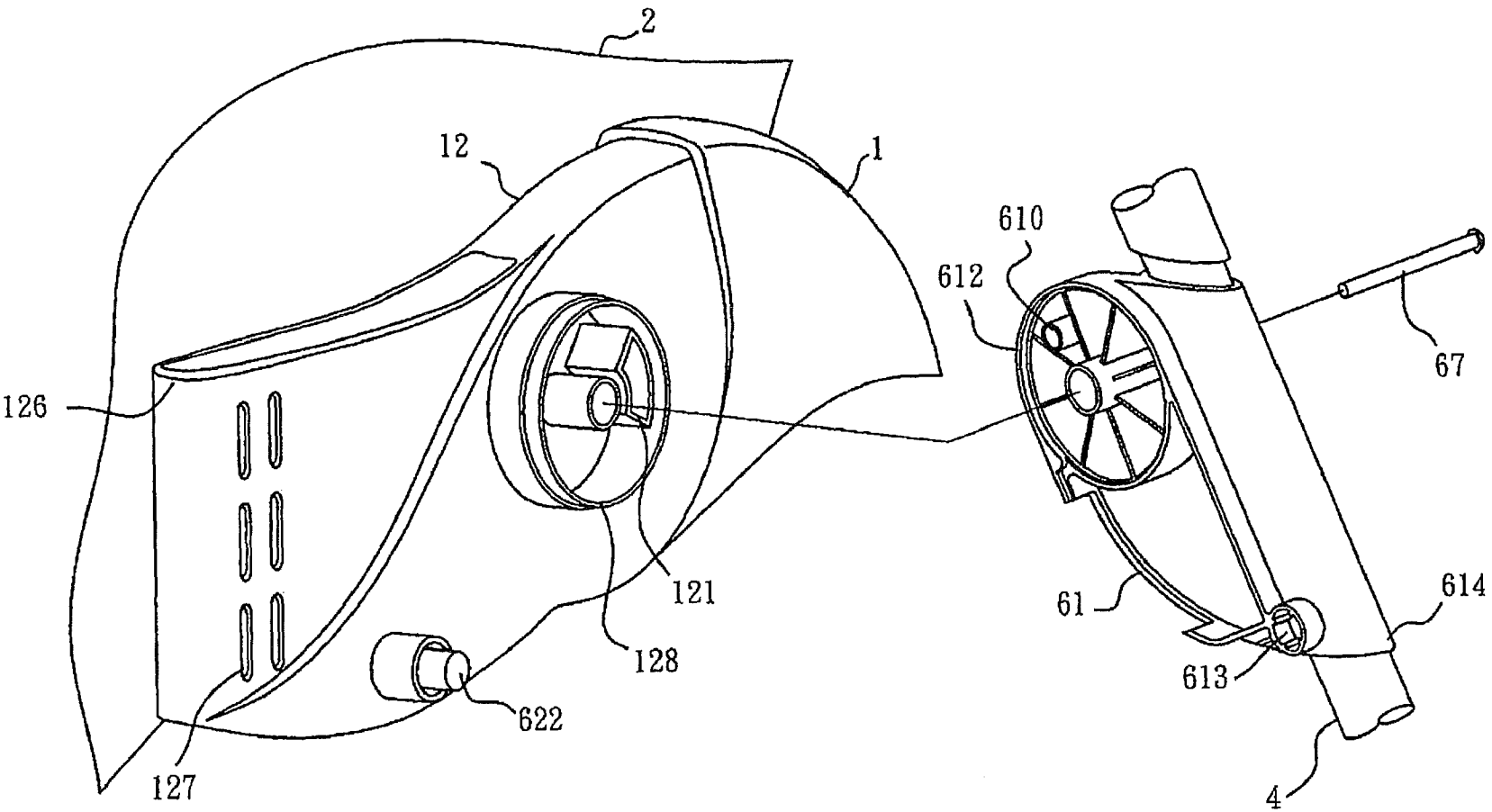
FIG. 10 is a partially exploded perspective view of the collapsible high chair according to the second preferred embodiment of the present invention illustrating the pivotal member of the adjust mechanism and the arm.
Figure 11:
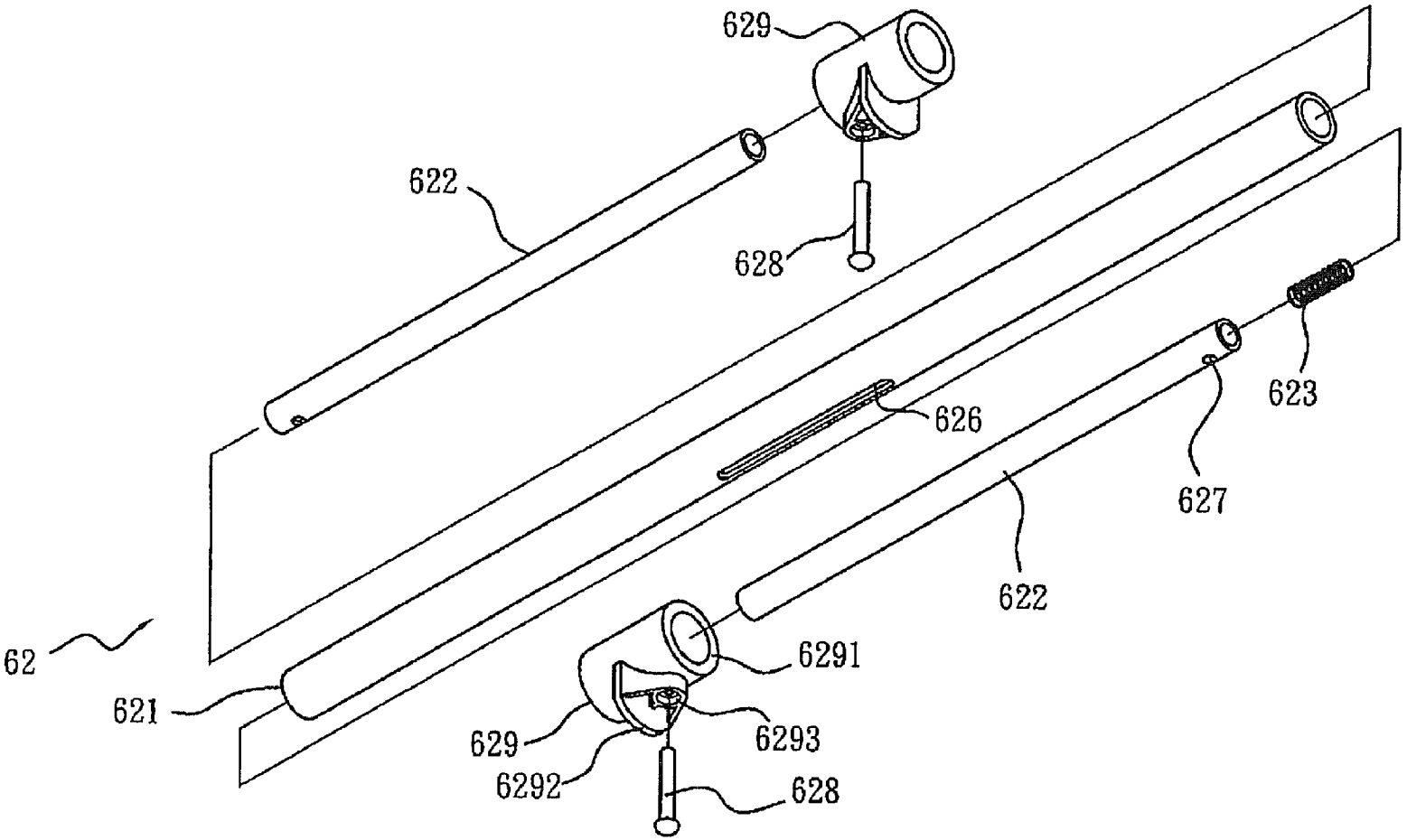
FIG. 11 is an exploded perspective view of the collapsible high chair according to the second preferred embodiment of the present invention illustrating the first engaging unit.
Figure 12:
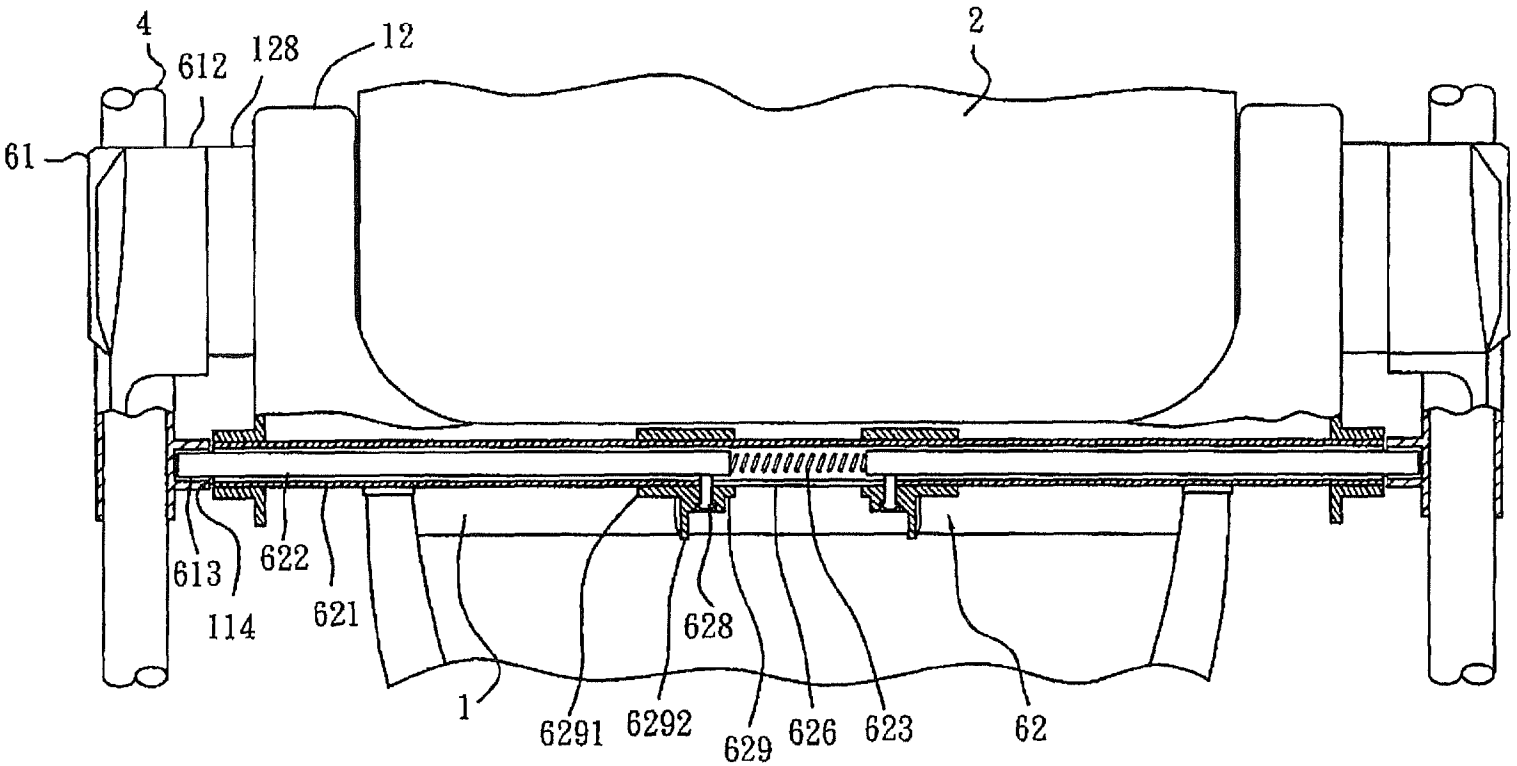
FIG. 12 is a partially sectional rear view of the collapsible high chair according to the second preferred embodiment of the present invention illustrating the first engaging unit in an engaging state.

As shown in FIGS. 10, 11 and 12, the adjusting mechanism 6 in the second preferred embodiment only includes two additional pins 67, two modified pivotal member 61 and a modified first engaging unit 62.

As shown in FIG. 10, each pivotal member 61 in the second preferred embodiment includes a cylindrical bulge 610 which is situated between the first collar 612 and a central perforation of the first collar 612.

As shown in FIG. 11, the first engaging unit 62 in the second preferred embodiment includes two actuating piece 629 and two third connecting elements 628. Each actuating piece 629 has a sleeve portion 6291, an ear 6292 perpendicularly extending away from the sleeve portion 6291, and an orifice 6293 which is formed adjacent to the ear 6292. The first rod 621 in the second preferred embodiment only has a flute 626 near the central region.

As shown in FIG. 10, the arm 12 in the second preferred embodiment includes a sectorial boundary 121 in the second collar 128.

Assembly: As shown in FIGS. 10, 11 and 12, when the pivotal member 61 is mounted with the arm 12 of the seat portion 1, the second collar 128 of the arm 12 is coupled with the first collar 612 of the pivotal member 61 and the bulge 610 is inserted into the sectorial boundary 121 at the same time. Then the pin 67 is passed through the central perforation of the first collar 612 and the central bore of the second collar 128 to pivotally connect the seat portion 1 and the pivotal member 61 together.

The first elastic element 623 and the two second rods 622 are inserted into the first rod 621 in the manner that the first elastic element 623 is situated between the two second rods 622. Moreover, The sleeve portions 6291 of the actuating pieces 629 are circumferentially mounted with the first rod 621 and then each actuating piece 629 is fixed with one, of the second rods 622 by passing a third connecting element 628, such as a screw, through the orifice 6293 of the actuating piece 629, the flute 629 of the first rod 621, and eyelet 627 in the second rod 622. After that, the above subassembly is secured to the seat plank 11 with two opposite ends of first rod 621 being firmly received in the holes 114.

Figure 13:
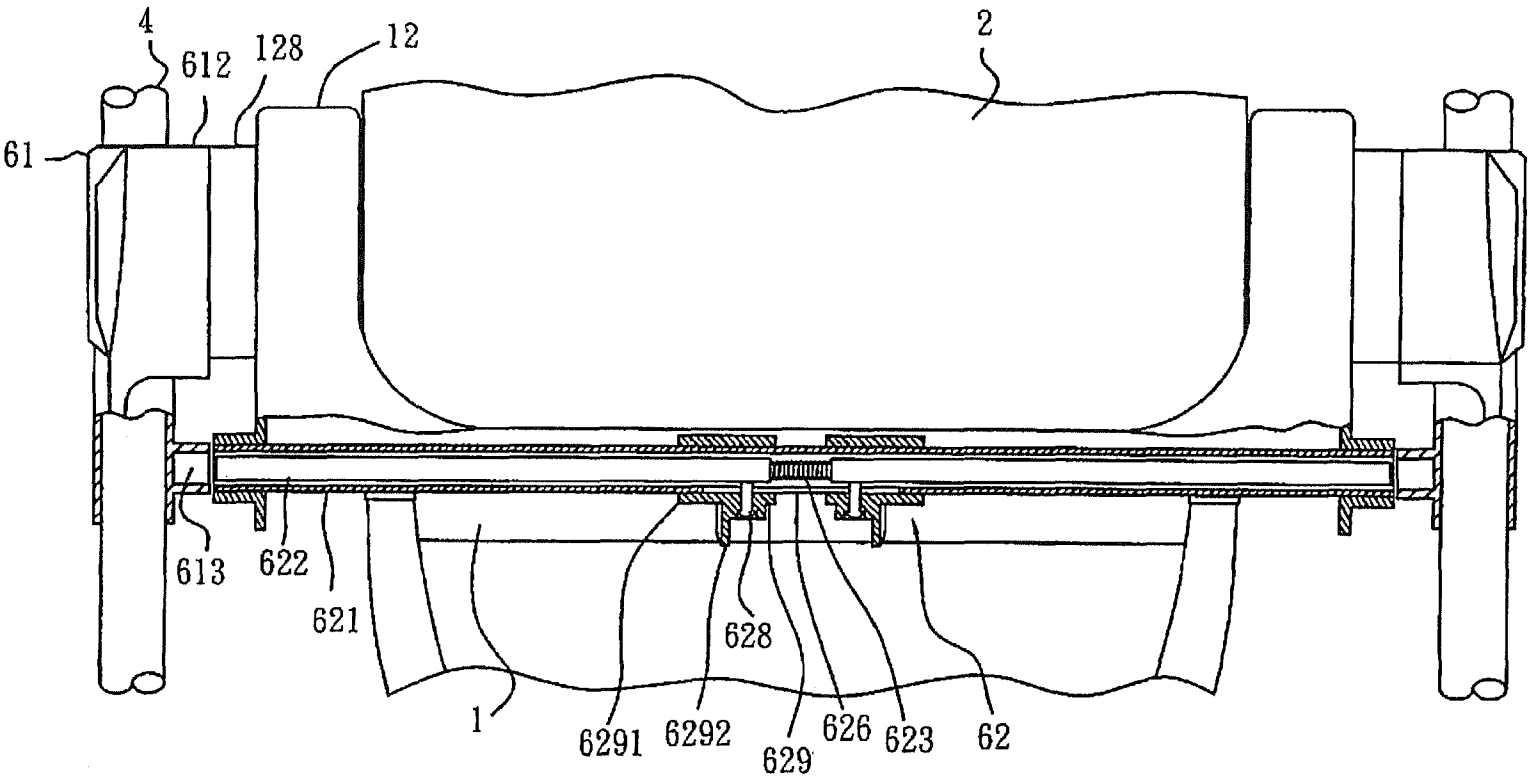
FIG. 13 is similar to FIG. 12 but illustrating the first engaging unit in an disengaging state.

Operation: As shown in FIG. 12, when the high chair 9 is in a stretched state, the seat portion 1 is connected with the pivotal member 61 at two portions, that is, the first portion "notch 613" and the second portion "collar 612". As shown in FIG. 13, when the two actuating pieces 629 are moved toward each other by a user's fingers respectively pushing the two ears 6292, the two second rods 622 are cooperated and also slid toward each other to compress the first elastic element 623 under the guidance of the third connecting elements 628 being slid in the flute 626. When the outside end of each second rod 622 is released from the notch 613 in the pivotal member 61, the collar 128, 612 and/or the pin 67 can function as the pivot for the seat portion 1 being pivotally rotated relative to the pivotal member 61 so as to allow the high chair 9 being collapsed.

Besides, because the cylindrical bulge 610 of the pivotal member 61 is received in the sectorial boundary 121 of the arm 12, the rotation angle of the seat portion 1 is dependent on the range of the sectorial boundary 121. When the cylindrical bulge 610 is situated at one end of the range, the high chair 9 is in stretched state. When the cylindrical bulge 610 is situated at another end of the range, the high chair 9 is in collapsed state.

Alternative Embodiment of Bulge and Boundary

Figure 14:
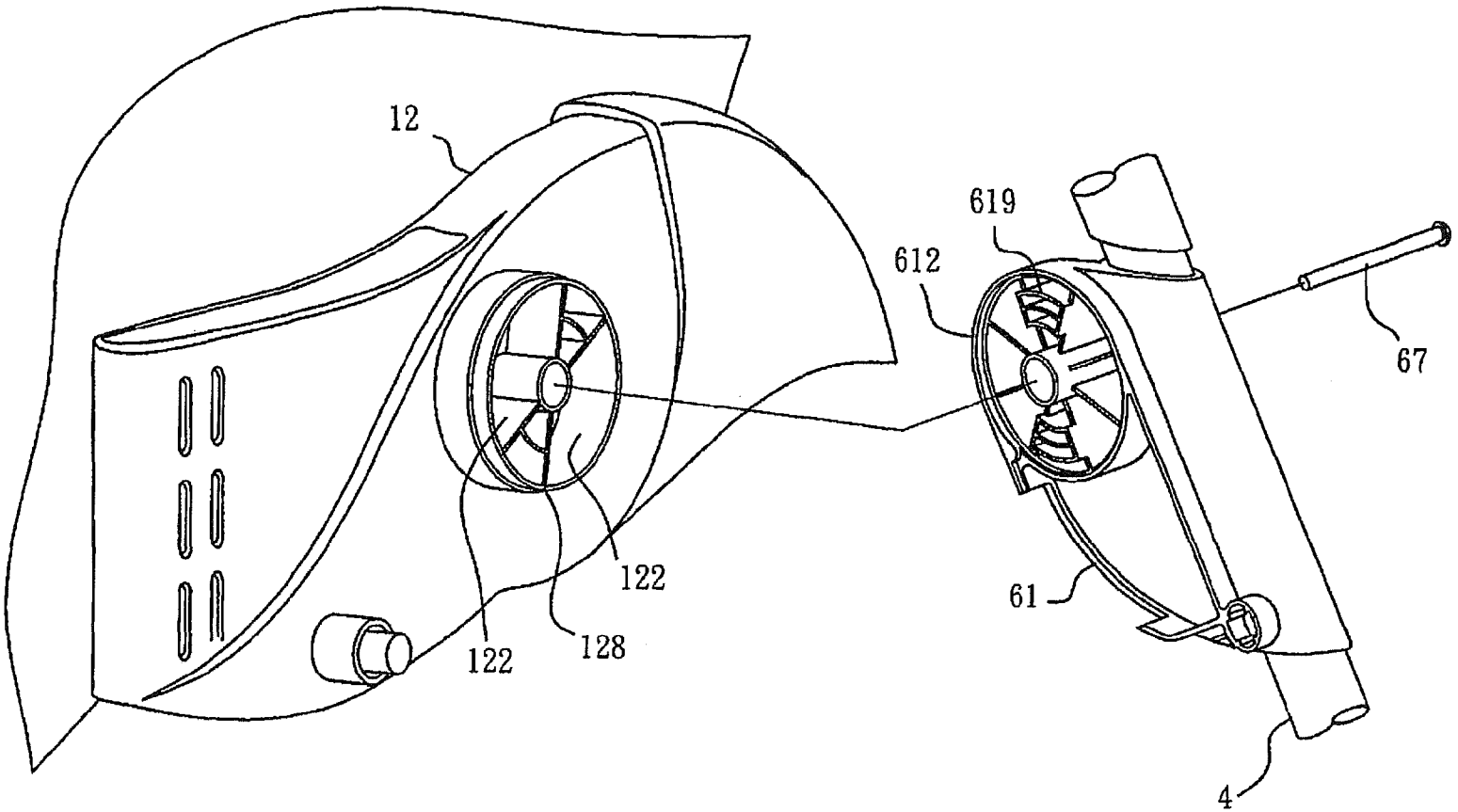
FIG. 14 is similar to FIG. 10 illustrating an alternative embodiment of a bulge in the pivotal member and a boundary in the arm.

As shown in FIGS. 10 and 14, the single cylindrical bulge 610 in FIG. 10 can be replaced by two sectorial bulges 619 in FIG. 14, and simultaneously the single sectorial boundary 121 in FIG. 10 can be modified as two larger sectorial boundaries 122 in FIG. 14. The sectorial bulges 619 are moveably received in the larger sectorial boundaries 122 respectively, which provides higher strength and safety for the high chair 9.

This invention has been disclosed in terms of specific embodiments. It will be apparent that many modifications can be made to the disclosed structures without departing from the invention. Therefore, it is the intent of the appended claims to cover all such variations and modifications as come within the true sprit and scope of this invention.

What is claimed is:

1. A collapsible high chair for children, comprising:

a seat portion;

a backrest pivotally connected to the seat portion;

a frame; and an adjusting mechanism which connects the seat portion with the frame;

said adjusting mechanism further comprising:

a pivotal member which is located on the frame and connected with the seat portion at a first portion and a second portion, which is spaced apart from the first portion of the pivotal member; and a first engaging unit which is installed on the seat portion;

said first engaging unit further comprising:

a first hollow rod secured with the seat portion;

a second rod movably received in the first hollow rod;

wherein the second rod fixes the seat portion at a predetermined angle relative to the frame when engaged with the pivotal member at the first portion, and allows the seat portion together with the backrest to be pivotally rotated relative to the frame about the second portion when the second rod is disengaged from the pivotal member.

2. The collapsible high chair for children as claimed in claim 1, wherein the first engaging unit further comprises a first elastic element and a third rod which are movably received in the first hollow rod, and the first elastic element is situated between the second and third rods.

3. The collapsible high chair for children as claimed in claim 1 or 2, wherein the first engaging unit further comprises an actuating piece which is secured with the second rod.

4. The collapsible high chair for children as claimed in claim 3, wherein the first engaging unit further comprises a third connecting element which secures the actuating piece with the second rod and is movably received in a flute of the first hollow rod.

5. The collapsible high chair for children as claimed in claim 4, wherein the actuating piece has an ear perpendicular to the second rod for being conveniently actuated.

6. The collapsible high chair for children as claimed in claim 4, wherein the actuating piece has a sleeve portion which is circumferentially and movably mounted with the first hollow rod.

7. The collapsible high chair for children as claimed in claim 1, wherein the adjusting mechanism further has a pin which is received within both the seat portion and the pivotal member at the second portion to serve as a pivot for the seat portion to be pivotally rotated.

8. The collapsible high chair for children as claimed in claim 1, wherein both the seat portion and the pivotal member respectively have a collar engaged with each other at the second portion to serve as a pivot for the seat portion to be pivotally rotated.

9. The collapsible high chair for children as claimed in claim 8, wherein the adjusting mechanism further has a pin which is located at centers of the collars and received within both the seat portion and the pivotal member at the second portion to serve as a pivot for the seat portion to be pivotally rotated.

10. The collapsible high chair for children as claimed in claim 7, 8 or 9, wherein the seat portion has an arcuate track and the pivotal member has a protrusion extending from the second portion, which is movably received in the arcuate track to limit a rotation range of the seat portion.

11. The collapsible high chair for children as claimed in claim 1, 7, 8 or 9, wherein the seat portion includes a seat plank and an arm extending away from the seat portion, and the first portion as well as the second portion of the pivotal member are respectively connected with the arm.

12. The collapsible high chair for children as claimed in claim 11, wherein the high chair further has a tray which is movably connected to the arm.

13. The collapsible high chair for children as claimed in claim 1, wherein the frame includes adjusting means such that the height of the pivotal member on the frame can be adjusted.

14. The collapsible high chair claimed in claim 13, wherein the frame has a plurality of apertures situated at different heights, and the pivotal member is provided with a tenon which is optionally positioned in one of the apertures to adjust the height of the pivotal member.

15. A collapsible high chair for children, comprising:

a frame;

a seat portion pivotally connected with the frame;

a backrest pivotally connected to the scat portion; and an engaging rod slidably connected to the seat portion and moveable between an engaging position where the engaging rod is engaged with the frame and a disengaging position where the engaging rod is released from the frame;

wherein the seat portion is stationary relative to the frame when the engaging rod is in the engaging position, and the seat portion together with the backrest is rotatable relative to the frame when the engaging rod is in the disengaging position, such that the seat portion and said backrest are rotated until the seat portion is adjacent to the backrest.

16. The collapsible high chair claimed in claim 15, wherein a receiving hollow rod is secured with the seat portion and the engaging rod is movably received in the receiving hollow rod.

17. The collapsible high chair claimed in claim 15 or 16, wherein the high chair further comprises a pivotal member which has a first portion and a second portion spaced apart from the first portion, wherein the pivotal member is located on the frame and pivotally connected with the seat portion at the second portion, and the engaging rod is retractably connected with the pivot member at the first portion.

18. A collapsible high chair for children, comprising:

a frame;

a seat portion pivotally connected with the frame;

a backrest pivotally connected to the seat portion; and a first engaging unit including a first hollow rod secured with the seat portion and a second rod coaxially received in the first hollow rod;

wherein the seat portion is stationary relative to the frame when the second rod is engaged with the frame and the seat portion together with the backrest is rotatable relative to the frame when the second rod is moved and released from the frame, such that the seat portion and said backrest are rotated until the seat portion is adjacent to the backrest.

19. The collapsible high chair claimed in claim 18, wherein the high chair further comprises a pivotal member which has a first portion and a second portion spaced apart from the first portion, wherein the pivotal member is located on the frame and pivotally connected with the seat portion at the second portion, and the first engaging unit is retractably connected with the pivotal member at the first portion.

20. The collapsible high chair claimed in claim 15 or 18, wherein the high chair further comprises a pivotal member which connects the seat portion with the frame and the pivotal member is moveable along the frame so that the height of the seat portion can be adjusted.

21. A collapsible high chair for children, comprising:

a seat portion;

a backrest pivotally connected to the seat portion;

a frame; and an adjusting mechanism which connects the seat portion with the frame;

said adjusting mechanism further comprising:

a pivotal member which is located on the frame and connected with the seat portion at a first portion and a second portion; and a first engaging unit which is installed on the seat portion;

said first engaging unit further comprising:

a first hollow rod secured with the seat portion;

a second rod movably received in the first rod;

wherein the second rod fixes the seat portion at a predetermined angle relative to the frame when engaged with the pivotal member at the first portion, and allows the seat portion to be pivotally rotated relative to the frame about the second portion when the second rod is disengaged from the pivotal member, such that the height of the pivotal member on the frame can be adjusted, and wherein the frame has a plurality of apertures situated at different heights, and the pivotal member is provided with a tenon which is optionally positioned in one of the apertures to adjust the height of the pivotal member.

* * * * *

UNITED STATES PATENT AND TRADEMARK OFFICE

CERTIFICATE OF CORRECTION

PATENT NO. : 7,735,911 B2
APPLICATION NO. : 11/285615
DATED : June 15, 2010
INVENTOR(S) : Shun-Min Chen It is certified that error appears in the above-identified patent and that said Letters Patent is hereby corrected as shown below:

In Claim 15, Column 10, line 57, please delete "scat" and replace with "seat"

Signed and Sealed this

Twentieth Day of July, 2010

David J. Kappos

David J. Kappos
*Director of the United States Patent and Trademark Office*